United States Patent [19]

Wunning et al.

[11] Patent Number: 4,653,732

[45] Date of Patent: Mar. 31, 1987

[54] MULTI-CHAMBER VACUUM FURNACE FOR HEAT-TREATING METAL ARTICLES

[75] Inventors: Joachim Wunning, Leonberg, Fed. Rep. of Germany; Wilhelm Neubauer, Wien, Austria

[73] Assignee: Aichelin GmbH, Korntal, Fed. Rep. of Germany

[21] Appl. No.: 688,724

[22] Filed: Jan. 4, 1985

[30] Foreign Application Priority Data

Feb. 15, 1984 [DE] Fed. Rep. of Germany ..... 3405244

[51] Int. Cl.[4] ..... C21D 9/00

[52] U.S. Cl. ..... 266/250; 266/259

[58] Field of Search ..... 266/249, 250, 259

[56] References Cited

U.S. PATENT DOCUMENTS 4,171,126 10/1979 Zahn et al. ..... 266/250

FOREIGN PATENT DOCUMENTS 3208574 9/1983 Fed. Rep. of Germany ..... 266/250

0155108 5/1982 German Democratic Rep. ..... 266/250

*Primary Examiner*—Christopher W. Brody

*Attorney, Agent, or Firm*—Frishauf, Holtz, Goodman & Woodward

[57] ABSTRACT

An industrial furnace for heat-treating metallic workpieces has separate heating and cooling chambers. The latter uses a circulating cooling gas, the flow of which against or past the workpieces produces cooling or gas-quenching. The furnace may have another chamber for oil-quenching lying below the gas-cooling chamber. In order to enable the gas cooling to operate quickly and efficiently, a cooling box fed with air by ventilator fans is provided in the shape of a tunnel, with internal surfaces above and at both sides of the effective cooling space constituted by interchangeable nozzle plates (or blank plates if no nozzle openings are desired at the top or at the sides). The workpieces to be cooled rest on a platform which may be raised or lowered to adjust the distance from the top nozzle plate or lowered into an oil bath. The nozzle plates provide a choice of nozzle patterns for different articles or groups of articles to be cooled after heat treatment. The nozzle plates may have setbacks or protrusions in order to vary the spacing of the nozzle openings from the median plane of the cooling tunnel.

11 Claims, 18 Drawing Figures

MULTI-CHAMBER VACUUM FURNACE FOR HEAT-TREATING METAL ARTICLES

This invention concerns an industrial furnace, particularly a multi-chamber vacuum furnace for heat treatment of aggregates of metallic workpieces, comprising a heating chamber containing a cooling system supplied with cooling gas. The cooling gas, which circulates through a heat exchanger, flows in contact with the furnace charge after heat treatment. The furnace may also be equipped with an oil bath.

Such heat treatment furnaces are used on a large scale for the hardening of steel parts, especially all kinds of articles of tool steel, as well as for various cooling processes and other heat treatments of metallic parts. An example of such a furnace is described in German published patent application (DE-OS) No. 26 08 850.

The three-chamber vacuum furnace shown in that reference has a heating chamber surrounded by a double-wall casing which is water cooled. There are also two cooling chambers adjacent to the heating chamber, one of which contains a cooling system operated with a cooling gas, while the other operates with a quenching oil bath. The cooling system in the first-mentioned cooling chamber has a cooling gas circulation system containing a fan by which the cooling gas is moved in circulation through a heat exchanger located outside of the casing and, with the assistance of guiding vanes, around the heat-treated charge located in the cooling chamber, in order to obtain rapid cooling down of the charge. The gas circulation in the cooling chamber brings it about that large quantities of gas need to be transported because of the relatively large gas duct cross-sections. Thus, for generating the high velocity of the gas passing by the charge required for rapid cooling down of the charge, high cooling gas velocities need to be maintained already in the duct between the fan and the charge, as well as in the return line from the charge to the heat exchanger and the fan, with the result that appreciable pressure losses must be expected in the entire rooling gas circulation loop. These pressure losses require either raised power requirements of the blower fan drive or else, in case of some limiting power rating of the fan motor, an undesired reduction of the cooling gas velocity in the region of the charge.

It is known that the cooling gas velocity necessary at the furnace charge can be obtained with substantially lower cooling gas quantities if the cooling gas comes into effect through nozzles which produce cooling air jets blowing on the charge. This gas cooling with nozzles inherently brings in the risk of non-uniform cooling results within the charge. In a single chamber vacuum furnace with gas cooling, such as is described in Austrian Patent No. 370 869, an effort was made to relieve this situation by providing nozzles in the heating chamber mounted on gas supply tubes parallel to the furnace axis and rotatable. about their respective axes. The gas supply tubes in this case project at one end out of the heating chamber where they are connected with a fixed gas supply system over flexible tubes and are connected to a drive for a swinging movement.

Apart from the considerable constructional expense required by the swingingly mounted gas supply tubes with their associated flexible connections and their drive, this cooling jet device can be adjusted for different kinds of charges only to a limited extent. The charge can basically be blown on merely from opposite sides, because the cooling gas supply and the drive system occupy the upper side of the heating chamber. The blow-on conditions necessary for optimal cooling, however, differ in a manner dependent upon the particular shape and composition of the charge. It makes a difference whether a charge that needs to be cooled consists of cylindrical cooling parts or of a number of plate-shaped workpieces.

SUMMARY OF THE INVENTION

It is an object of this invention to provide an industrial furnace, particularly a multi-chamber vacuum furnace, with a cooling chamber containing a gas cooling apparatus by which it is possible to obtain an optimum fitting of the onflow conditions of each particular charge to be cooled to the characteristics of this charge and to make this possible in a simple way without requiring apparatus that is complicated, costly or difficult to operate and maintain.

Briefly, the cooling apparatus is equipped with nozzle orifices discharging into the cooling chamber for blowing cooling gas on the charge and the respective nozzle orifices fixedly located in the cooling chamber are disposed in selectively interchangeable members of the apparatus for varying the gas impingement conditions on the charge.

In a preferred embodiment, the nozzles are constituted for interchange by groups for variation of the nozzle pattern and/or of the nozzle diameter and/or of the nozzle spacing.

The new furnace according to the invention makes it possible to produce by cooling gas velocities in the cooling chamber only where maximum cooling effect is need at or within the charge to be cooled and to do this by corresponding selection of the nozzle pattern, distribution and other characteristics.

In this connection it is desirable for the spacing of at least a few nozzles from the furnace charge to be adjustable. It is also advantageous for at least a few nozzles to be arranged in a disposition which will provide an impinging jet of cooling gas on the charge or which will provide a parallel flow of cooling gas on the charge, or for some nozzles providing the former and others the latter. For a given cooling gas throughput capacity, the maximum cooling rate of the charge depends basically on the heat transfer values obtained. It is known that the gas flowing against the charge has a decisive influence on the magnitude of the charge to cooling gas heat transfer, with impinging flow producing higher heat transfer values than parallel flow, in which the cooling gas flows parallel to the workpiece surfaces. Other parameters for the heat transfer are, among others, nozzle exit velocity, nozzle diameter, nozzle spacing from the charge, spacing of the nozzles from each other, average cooling gas temperatures and average charge temperatures.

The nozzles are advantageously disposed in the cooling chamber surrounding the charge on two or more sides. A particularly simple construction relationship results if the cooling device is provided with a nozzle box fed with cooling gas suitably disposed in the cooling chamber and having at least one removable nozzle plate set in the box and lying opposite to the furnace charge. For this purpose, the nozzle box may have guiding means in which the nozzle plate can be inserted and slid into place.

By simple interchanging of the nozzle plates, the above-mentioned fitting of the cooling device to the above-mentioned parameters for heat transfer can be obtained in a very simple way. The individual nozzle plates interchangeable with each other can have not only different nozzle patterns and nozzle diameters, etc., but also, for example, one nozzle plate can also have a region protruding into the interior of the cooling chamber or set back therefrom, in order to make possible a change of the spacing between the nozzles and the furnace charge according to the particular conditions of the case.

As a rule, the charge to be heat-treated is surrounded by nozzles on several sides, so that the nozzle box will accordingly be constituted in tunnel shape abounded on its internal walls by nozzle plates. At least one such nozzle plate can, if desired, be replaced by a blank plate through which no gas is discharged. In this manner an effective impingement flow can be obtained for plate-shaped workpieces, by inserting lateral nozzle plates and also a blank plate above the charge, so that the upstanding workpiece can be cooled optimally from all sides. In the case of a charge of cylindrical standing tools, it is possible to operate only by means of a parallel flow for throughflowing cooling, because impingement cooling is not possible on account of the workpiece shape and the large number of workpieces. For the latter type of throughflow cooling, there can be inserted a nozzle plate at the top and blank plates on both sides of the charge. The nozzle spacing from the charge can then be optimized at each side by the kind of nozzle plates already mentioned having a region protruding into the cooling chamber or set back therefrom.

BRIEF DESCRIPTION OF THE DRAWINGS

The invention is further described by way of illustrative example with reference to the annexed drawings, in which.

DESCRIPTION OF THE ILLUSTRATED EMBODIMENTS

Figure 1:
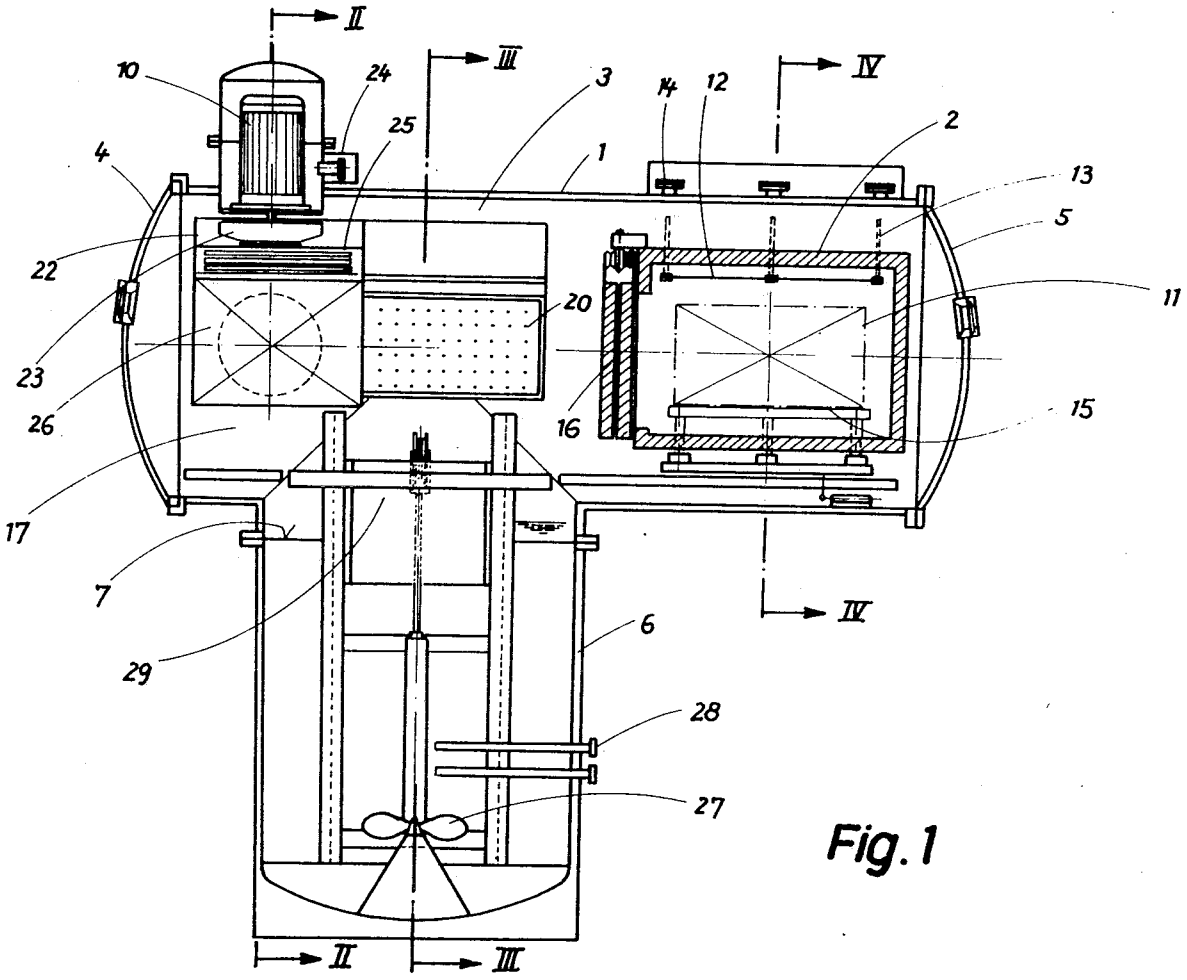
FIG. 1 is a side view of a double-chamber vacuum furnace according to the invention, shown in axial section.

The double-chamber vacuum furnace shown in FIGS. 1–4 has a double-walled, water-cooled housing 1 in the rear portion of which is a heating chamber 2 and in the front portion of which a cooling chamber 3 is provided. The essentially cylindrical housing 1 is closed both on the front side by a swinging or sliding water-cooled double-walled door 4 serving for loading and unloading the furnace. On the rear side of the furnace, in the region behind the heating chamber 2, a double-walled swinging door 5 is provided which closes off an opening in the housing provided for assembly purposes. Below the cooling chamber 3 a double-walled, water-cooled container 6 is connected to the housing 1 by means of a flange. In the container 6 is an oil bath, the surface level of which is indicated at 7.

Figure 2:
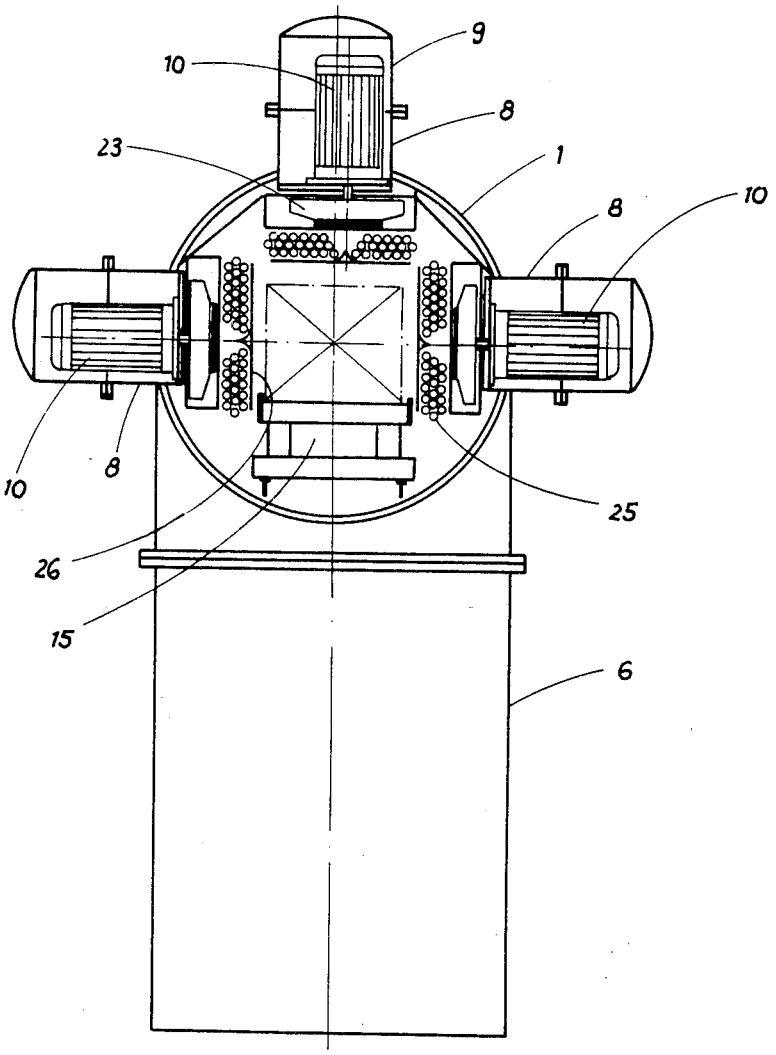
FIG. 2 is a section along the line II—II of FIG. 1, likewise a side view of the double-chamber vacuum furnace of FIG. 1.

In the front portion of the cooling chamber 3, the housing 1 bears three radially extending flanged fittings 8 distributed around the circumference of the housing in the manner shown in FIG. 2, on which there are set the double-walled, water-cooled domed caps 9, each of which covers a fan drive equipment 10. The heating chamber 2, which is essentially rectangular in cross-section, is constructed in accordance with steel-like construction methods and is cladded with multilayer insulation of high-quality ceramic fiber material and graphite felt of the highest purity. On both sides and above the furnace charge designated 11, there are disposed graphite heating elements 12 of large surface. This encircling arrangement of the graphite heating elements 12 provides for a rapid and uniform heating up of the charge 11. The electric current supply of the graphite heating elements 11 is connected through heating element feed-through rods 13, each equipped with a heating element connection flange 14.

The charge 11 in the heating chamber 2 lies on a hearth 15 which is equipped for raising and lowering for transport purposes. The end wall of the heating chamber 2 at the boundary of the cooling chamber 3 is closed by a horizontally movable heating chamber door 16.

It should be mentioned that the heating chamber 2 is designed for the smallest possible heat storage and to serve as well as possible for heat-treatment according to a preselected temperature program. As compared with a single chamber furnace, no account needs to be taken,in this design, either of cooling gas supply and cooling gas velocity or of other parameters for the removal of heat from the charge.

Figure 3:
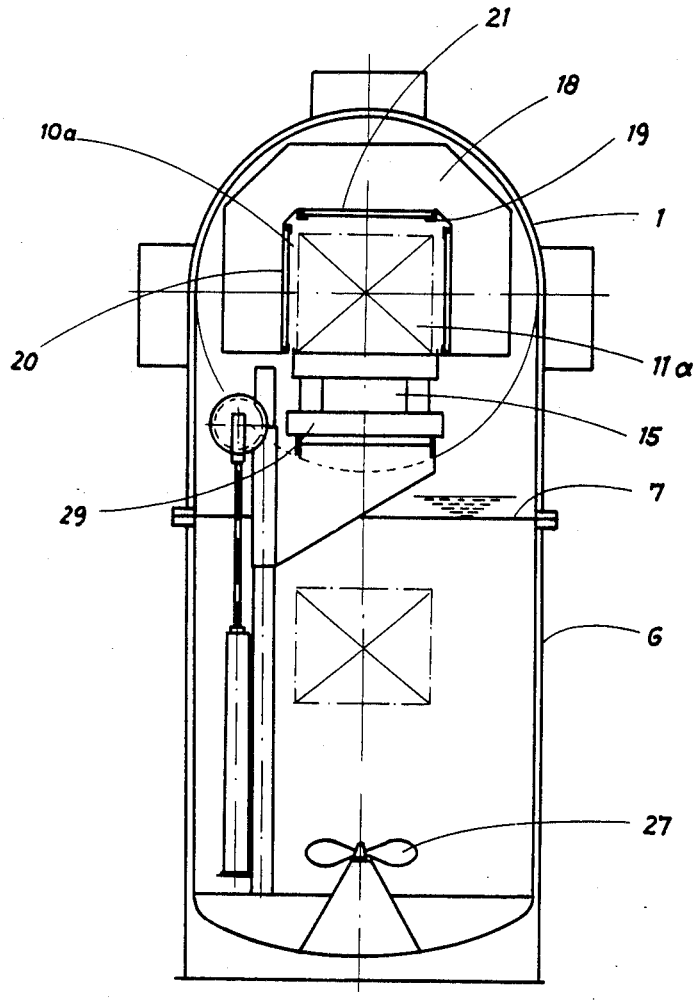
FIG. 3 is a section along the line III—III of FIG. 1, likewise a side view, of the double-chamber vacuum furnace of FIG. 1.
Figure 4:
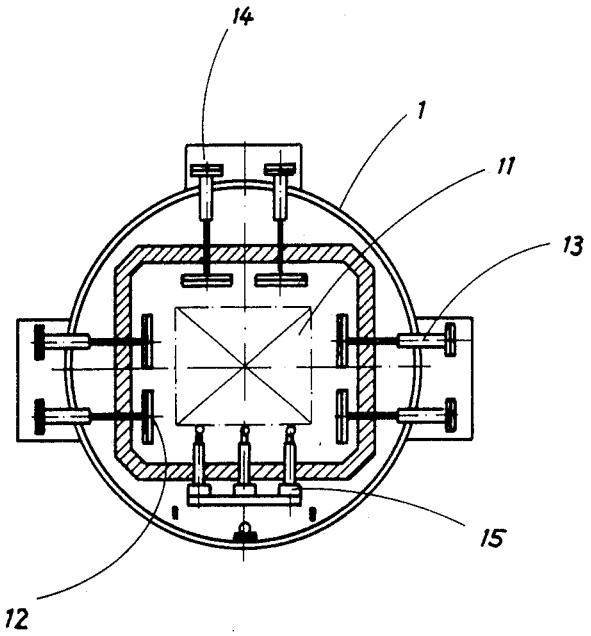
FIG. 4 is a section along the line IV—IV of FIG. 1, likewise a side view, of the double-chamber vacuum furnace of FIG. 1.

The cooling chamber 3 disposed more or less coaxially to the heating chamber 2 contains a cooling apparatus 17 which includes a nozzle box 18 constructed in tunnel shape, of essentially U-shaped cross-section, covering on top and on both sides, in the manner visible particularly in FIG. 3, a heat-treated charge 11*a* which is to be cooled down. The nozzle box 18 carries, on its inner sides facing the charge 11*a*, lateral guiding grooves 19 arranged together in pairs, into which the nozzle plates 20,20*a* or blank plates 21 can be inserted selectively and interchanged, as will be further explained with reference to FIGS. 5–18.

At its forward end, the nozzle box 18 is directly connected with three fan housings 22, each of which contains a high-power ventilating fan 23 that is mounted directly on the shaft end of the corresponding drive motor 10. The vacuum-tight current feedthroughs for the motor are designated 24. Two heat exchangers 25 mounted laterally forward at the suction opening of each fan housing 22. The heat exchangers are supplied with cooling water through vacuum-tight inlets and outlets and are likewise equipped with gas supply ducting 26.

In the illustrated embodiment, three fan housings 22 and three corresponding fan units 10,23 are provided. It is of course also possible to have embodiments in which only two fan housings 22 are present or in which only a single fan housing 22 is present.

The oil bath contained in the vessel 6 can be evenly and powerfully stirred by a hydraulic oil stirrer 27, in which case the speed of the oil stirrer 27 is controllable as necessary. An oil bath thermometer 28 makes it possible to bring the vacuum-quenching oil to the temperature required in the particular case and to hold it at that temperature.

A raising and lowering platform 29 is provided in the container 6 in order to bring a heat-treated charge 11*a* coming out of the heating chamber 2 into the cooling chamber 3 to a particular height with reference to the nozzle box 18—as is yet to be explained in detail—or to dip the charge 11*a* into the quenching oil present in the container 6. The container 6 and its oil bath contained therein can be dispensed with in the base of a double-chamber vacuum furnace designed to be used without oil quenching.

When the door 4 is opened, the double-chamber vacuum furnace can be charged by hand or automatically, after which the charge 11 is moved automatically into the open heating chamber 2. Thereafter, the heating chamber door 16 and the door 4 for closing the loading opening are closed. Then the vacuum furnace is evacuated.

The charge 11 is first heat-treated according to a preselected temperature program in the heating chamber 2. At the end of the heating cycle, the vacuum furnace is again filled with gas using an inert gas under a pressure of not more than 6 bars.

The fan drive motors 10 are then turned on. The heating elements 12 are switched off and the charge 11 is moved into the cooling chamber 3 where it takes the position of the charge 11*a* and is quenched with cooling gas.

With corresponding actuation of the raising and lowering platform 29 the charge can be moved up against the above-lying nozzle plate 20 as may be required.

If the charge 11 after its heat-treatment in the heating chamber 2 is to be quenched in oil, then after it is moved out of the heating chamber 2 it is lowered into the oil bath by means of the rising and falling platform 29. According to requirements of the heat-treatment, it can be pre-cooled briefly with inert gas before oil quenching. The double-chamber vacuum furance is automatically controlled. The complete heat-treating cycle can be preselected.

The nozzle box 18 is so constituted that only small gas velocities appear therein. Such low gas velocities on the one hand generate only slight flow losses and on the other hand produce equal pressure ratios at the nozzles of the nozzle plates 20,20*a*, thus leading to equal nozzle exit velocities, which are a requirement that is counted on for producing even cooling downing of the charge 11*a*.

Since the nozzle plates 20,20*a* in the nozzle box 18 are interchangeable and can, if desired, be replaced by blank plates 21, the quenching conditions in the cooling chamber 3 can be fitted optimally to the shape and composition of each charge 11*a*. This is made clear by way of example in FIGS. 5 to 18.

Figure 5:
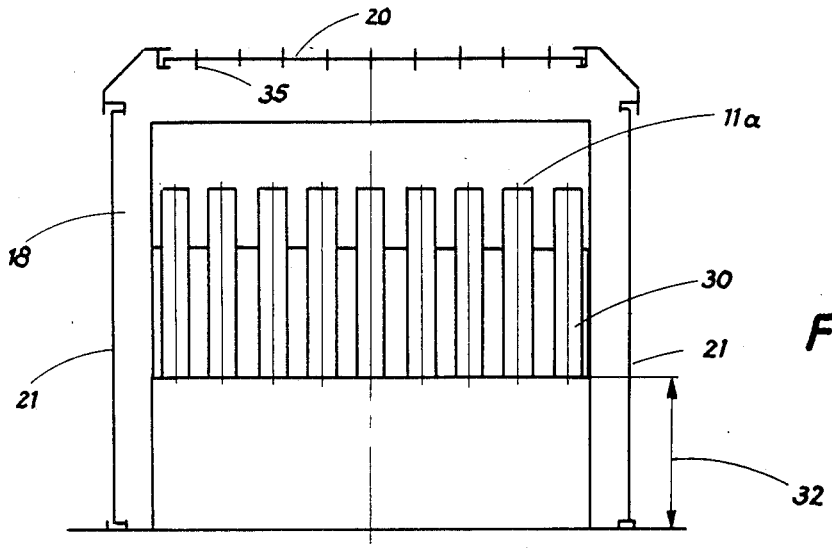
FIG. 5 is a diagrammatic side view in cross-section, on a different scale, of the nozzle box of the double-chamber vacuum furnace of FIG. 3, showing a particular furnace charge and a particular nozzle arrangement.
Figure 6:
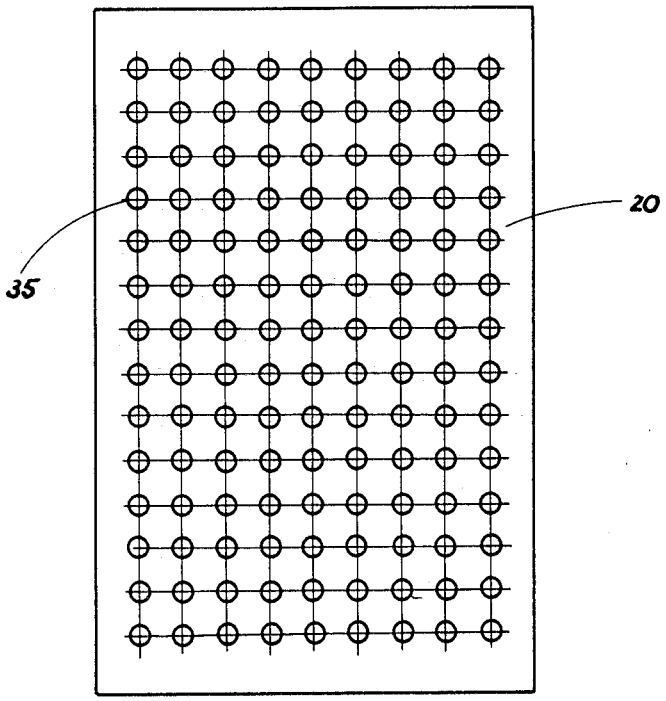
FIG. 6 is a plan view, from above, of the nozzle plate above the charge in the apparatus of FIG. 5.

In the arrangement of FIG. 5, the charge 11*a* which is to be quenched consists of a number of slim cylindrical tools, for example spiral drills or milling cutters of 45 mm diameter by 300 mm length. In order to hold down to a small value the delay in heat-treatment and quenching, the cylindrical workpieces designated 30 are charged standing vertically and are distributed uniformly on the charging base surface. The charge base surface corresponds to the rectangular outline surface of the nozzle plate 20 shown in FIG. 6. For uniform and intensive gas quenching, it is necessary to have through-flow cooling with parallel flow of gas. For this purpose, a horizontal nozzle plate 20 is inserted in the nozzle box 18 above the charge 11*a*, while blank plates 21 are provided at the sides of the charge 11*a*. The nozzle plate 20 carries nozzle openings 35 (FIG. 6) distributed evenly over its entire surface, so as to provide for uniform and simultaneous cooling down of all workpieces 30.

The spacing of the nozzle openings 35 from the charge 11*a* is optimized by lifting the charge with the rising and falling platform 29. The amount of rise is shown at 32 in FIG. 5.

Workpieces that require the entire charge length that is available must be charged lying down. This is made clear in FIGS. 7 and 8.

In order to be able to utilize fully the giving off of heat by radiation to the surrounding cold cooling chamber walls, the charge 11*a* consists merely of one workpiece 33 in the form of a cylindrical arbor. Since this arbor has a relatively small onflow surface in comparison to the rectangular outline surface of the nozzle plate 20*a* of the charge base surface provided in FIG. 8, it is necessary to have a cooling gas flow concentration in the region of the workpiece 33 to be cooled, in order to obtain maximum cooling velocities. This requirement can be met either by reducing the number of nozzle openings 35 with simultaneous raising of the nozzle exit velocity or by reducing the nozzle spacing 36 (FIG. 8) while keeping the same number of nozzles.

On the basis of the above considerations, a nozzle plate 20*a* is inserted in the nozzle box 18 above the charge 11*a* which has a region 40 protruding into the interior space of the cooling chamber 3, in which region the nozzle openings 35 are provided. The nozzle plate 20*a* is thereby constituted in channel or box-like shape.

The region containing the nozzle openings 35 is bounded on both sides by an imperforate region 41.

Figure 7:
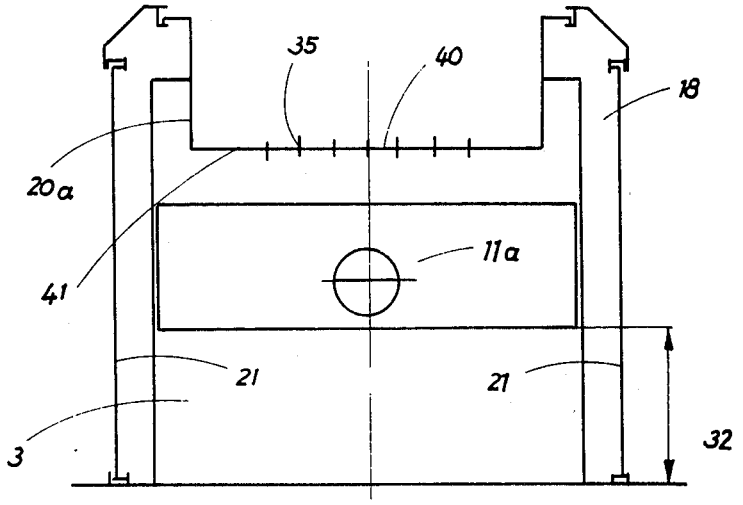
FIG. 7 shows the nozzle box according to FIG. 5 with another arrangement of the nozzle plates, in a corresponding representation.

As shown at 32 in FIG. 7, the workpiece 33 is, moreover, brought towards the nozzle openings 35 by the rising and falling platform 29 to assist in meeting the requirements above described.

Figure 8:
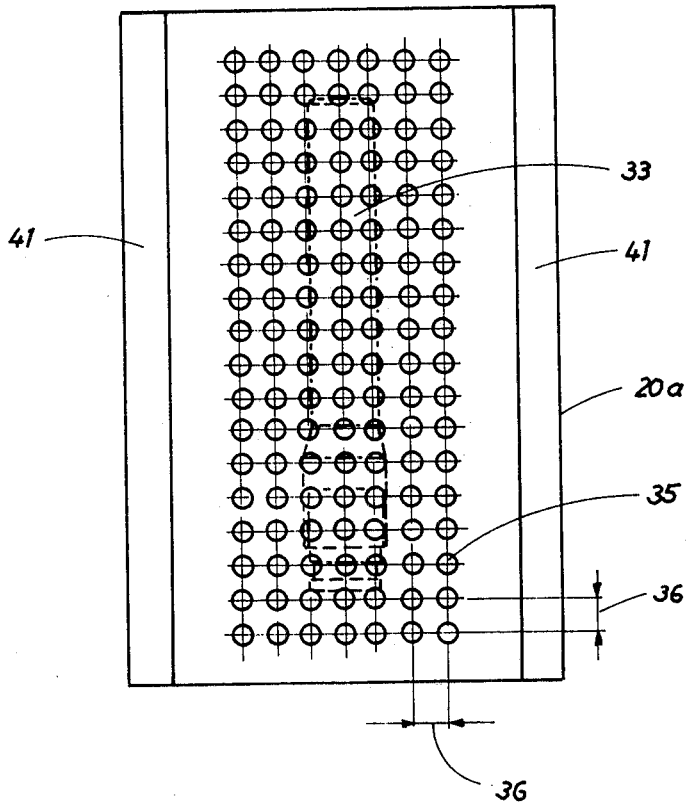
FIG. 8 is a plan view of the nozzle plate disposed above the furnace charge in the arrangement of FIG. 7.

The nozzle pattern is determined in this case in the manner evident from FIG. 8 in a rectangular arrangement with nozzle bores 35 of the same diameter arranged with equal spacings in both rectangular dimensions.

Blank plates 21 are inserted in the nozzle box 18 to each side of the workpiece 33 to prevent impingement of oppositely directed cooling gas streams upon each other in the neighborhood of the workpiece, since in that way the cooling gas velocity would be substantially reduced immediately next to the workpiece 33.

Figure 9:
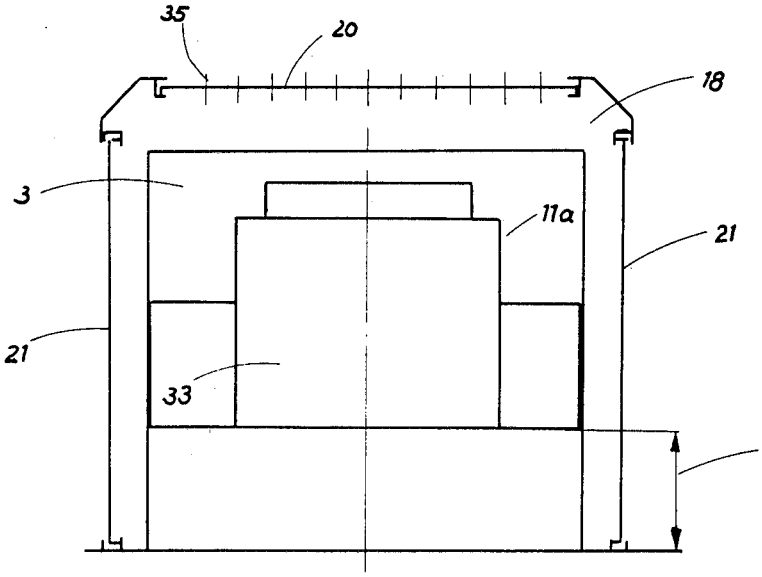
FIG. 9 shows the nozzle box according to FIG. 7 in a representation corresponding to FIGS. 7 and 5.
Figure 10:
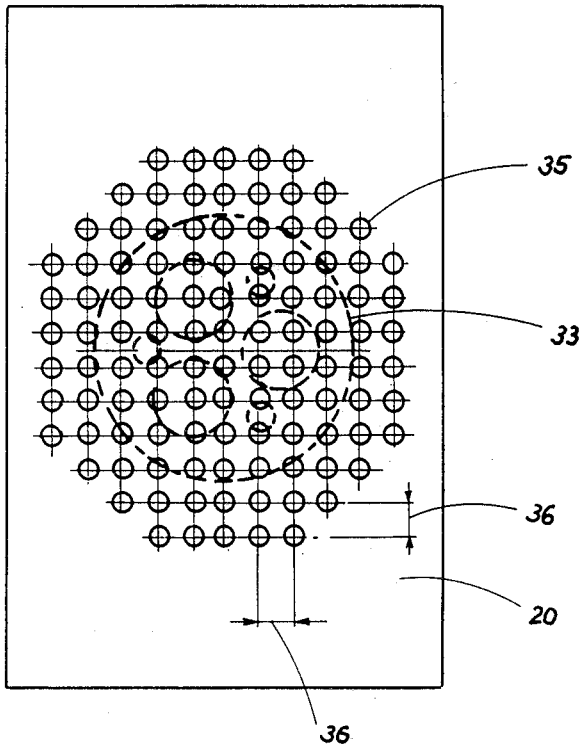
FIG. 10 is a plan view of a nozzle plate disposed at one side of the charge in the arrangement according to FIG. 9.

In the arrangement according to FIGS. 9 and 10, the charge 11*a* consists of a heavy convoluted or compact tool, for example a female mold which has only small protruding onflow surfaces as compared again to the charge base surface represented by the rectangular outline of the nozzle plate 20 (FIG. 10). The most effective cooling is produced by the combination of impinging flow of the upper end surface on the one hand and parallel flow along the cylindrical wall surfaces and along the bores of the workpiece 33, while two blank plates 21 are set in the nozzle box 18 on the respective sides of the workpiece 33. The nozzle pattern of the upper nozzle plate 20 is, as shown in FIG. 9, a checkerboard arrangement with octagonal boundaries with all nozzle openings 35 being spaced from each other by the same spacing 36 in both of the rectangular dimensions of the plate 20.

For optimizing the cooling effect, the workpiece 33 is raised, as shown at 32, towards the upper nozzle plate 20 by means of the rising and falling platform 29 in the cooling chamber 3.

Figure 11:
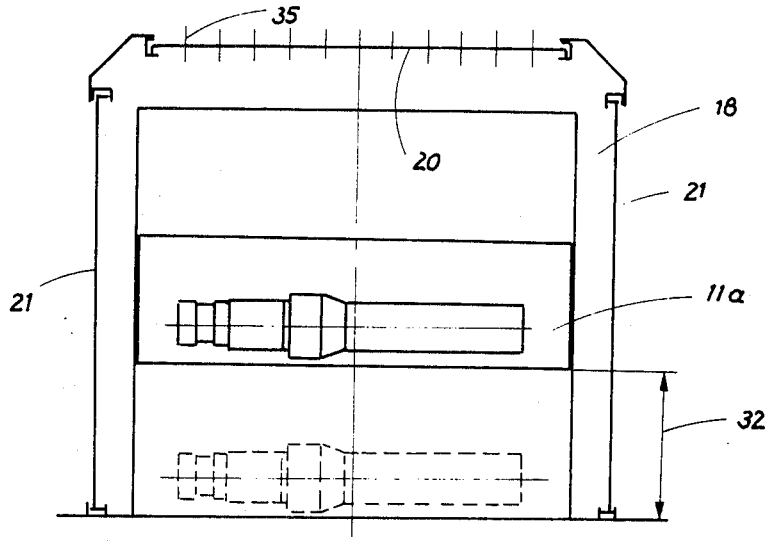
FIG. 11 shows the nozzle box according to FIG. 5 with still a different arrangement of nozzle plates, in a corresponding representation.
Figure 12:
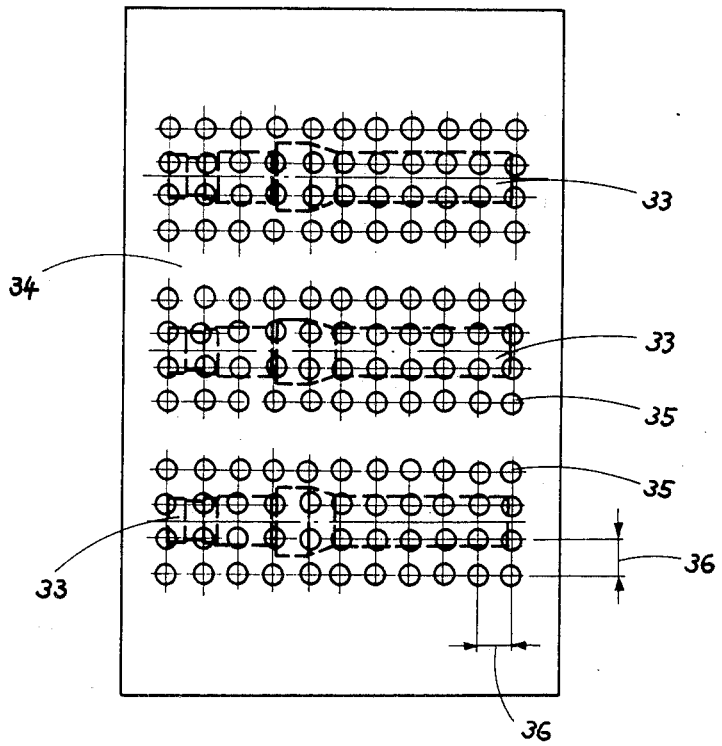
FIG. 12 is a plan view of a nozzle plate disposed above the charge in the arrangement of FIG. 11.

In FIGS. 11 and 12, a charge 11*a* is shown which consists of several cylindrical punches 33. In this case two blank plates 21 are inserted in the nozzle box 18 on the respective long sides of the total charge, facing the ends of the cylindrical tools, while above the charge 11*a* there is provided a nozzle plate 20 having a nozzle pattern illustrated in FIG. 12. In this case the nozzle openings 35 are arranged in three rectangular groups centered on the respective three punches 33, these three groups of nozzle openings being separated from each other by gas-impermeable strips 34. Within the nozzle opening groups 35, there is again a checkerboard array with the same spacing 36 in both dimensions.

The charge 11*a* here again can be brought up towards the nozzle plate 20 as shown at 32 in FIG. 11 by means of the rising and falling platform 29. There might be reasons, however, to have the charge 11*a* in this case be quenched by gas at a greater spacing from the nozzle plate 20 above it, an alternative procedure indicated by broken lines in FIG. 11.

Figure 14:
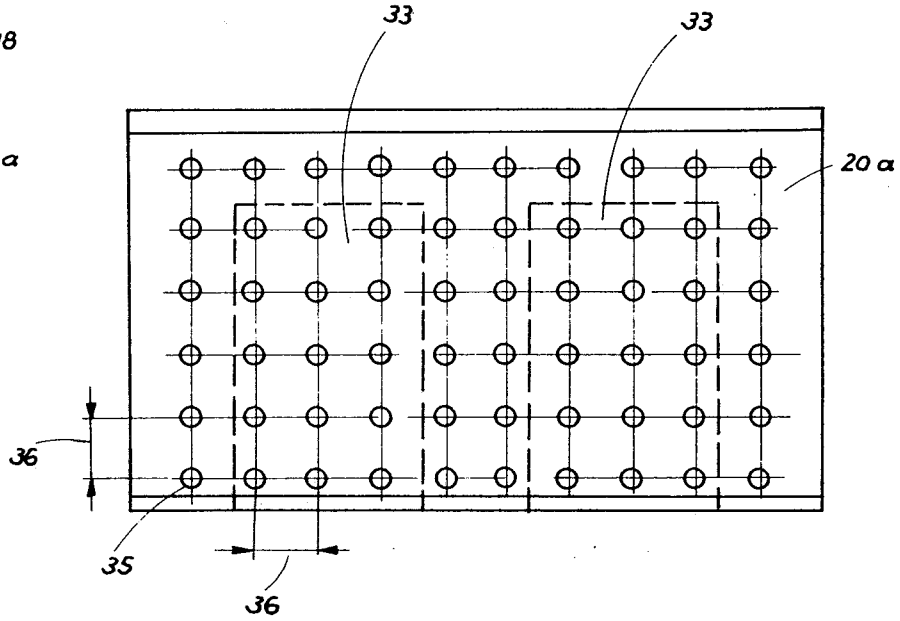
FIG. 14 is a plan view of a nozzle plate disposed alongside the charge in the arrangement of FIG. 13.
Figure 13:
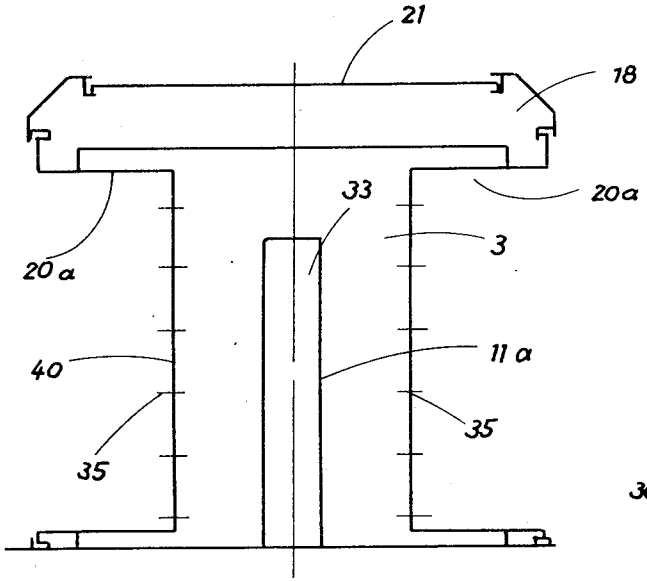
FIG. 13 shows the nozzle box according to FIG. 5 serving another charge, in a corresponding representation.

FIGS. 13 and 14 show a typical example of a charge 11*a* quenched by intensive gas-impingement cooling. The charge in this case consists of two plate-shaped workpieces 33, for example injection moldings or other pressure castings. Above these workpieces there is a blank 21 in the nozzle box 18, whereas alongside of these workpieces standing on edge parallel to the sides of the nozzle box there are located on opposite sides to nozzle plates 20*a* which, as shown in FIG. 3, have a region 40 protruding into the cooling chamber 3 bringing the nozzle openings 35 fairly close to the broad surfaces of the workpieces.

The roughly plate-shaped workpieces 33 stood upright in the higher-temperature region of the heating chamber 2 during their heat-treatment there in the vacuum furnace for reducing delay in treatment. In the cooling chamber, efficiency is similarly obtained, as already explained, by having the nozzle openings 35 of the box-like nozzle plates 20*a* close to the lateral surfaces of the charge so that these nozzle openings arranged in accordance with the pattern shown in FIG. 14, distributed over the horizontal and vertical dimensions of the aggregate lateral surface of the charge evenly with the same spacing 36 in both dimensions, can assure a uniform and simultaneous cooling-down of the workpieces 33.

Figure 16:
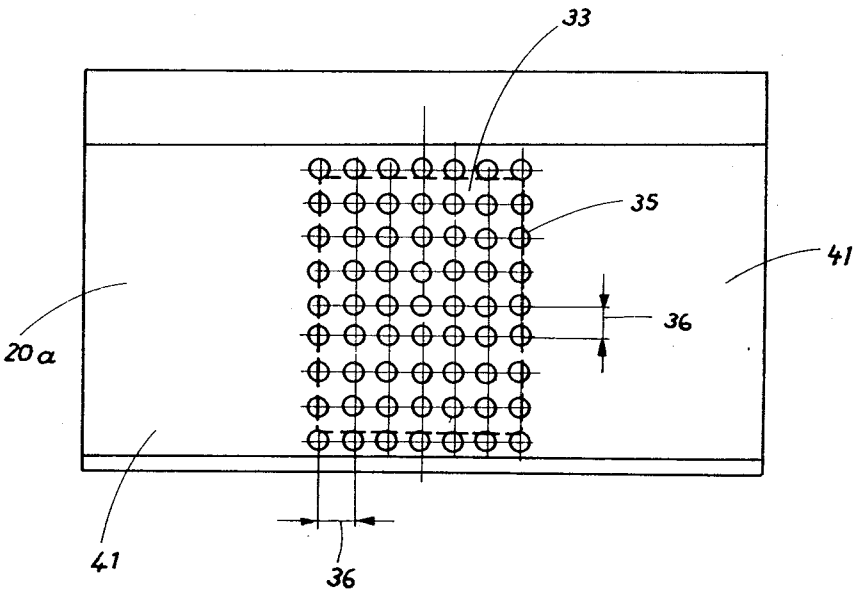
FIG. 16 is a plan view of a nozzle plate arranged alongside the charge in the arrangement according to FIG. 15.
Figure 15:
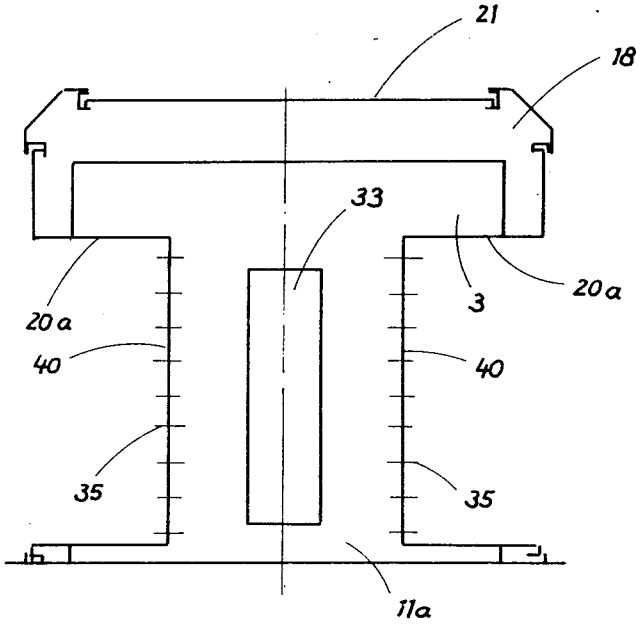
FIG. 15 shows the nozzle box according to FIG. 5 serving still a different charge, in a corresponding representation.

In the arrangement of FIGS. 15 and 16, a single plate-shaped workpiece 33, for example a pressed article, is quenched in the cooling chamber 3 where, in a manner similar to FIG. 13, the nozzle box of the chamber is provided with a blank plate 21 at the top and a pair of box-like nozzle plates 20*a* at the respective sides.

In order to obtain extreme optimization of the cooling conditions, the nozzle plates 20*a* are provided with a nozzle pattern specifically designed for the lateral surfaces of the charge. As shown, the nozzle openings 35, which again have the same spacing 36 from each other both laterally and in height, are concentrated in a rectangular region substantially corresponding to the side surfaces of the charge, while the remaining regions 41 of the plate do not allow the passage of any cooling gas through the plate. With the reduction of the number of nozzle openings 35 by this limitation of the area in which the nozzle openings are found, there results an increase of the nozzle exit velocity. Furthermore, the spacing of the nozzle openings 35 from the workpiece or charge surface is optimized by the use of the box-like nozzle plates 20*a* which bring the nozzle openings to an appropriate distance from the charge as already described. The impinging gas flow thus applied to both sides of the workpiece assures an intensive and undelayed cooling-down of the charge 11*a*.

Figure 17:
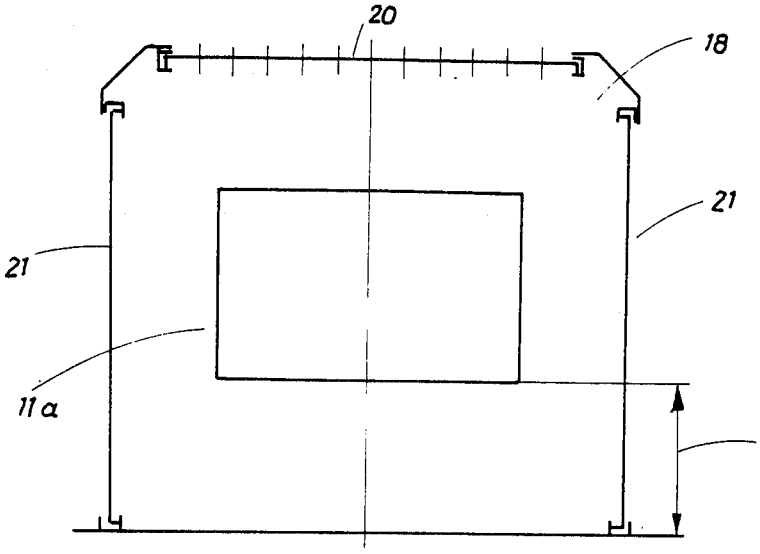
FIG. 17 shows the nozzle box according to FIG. 5 with still a different arrangement of the nozzle plates, in a corresponding representation.
Figure 18:
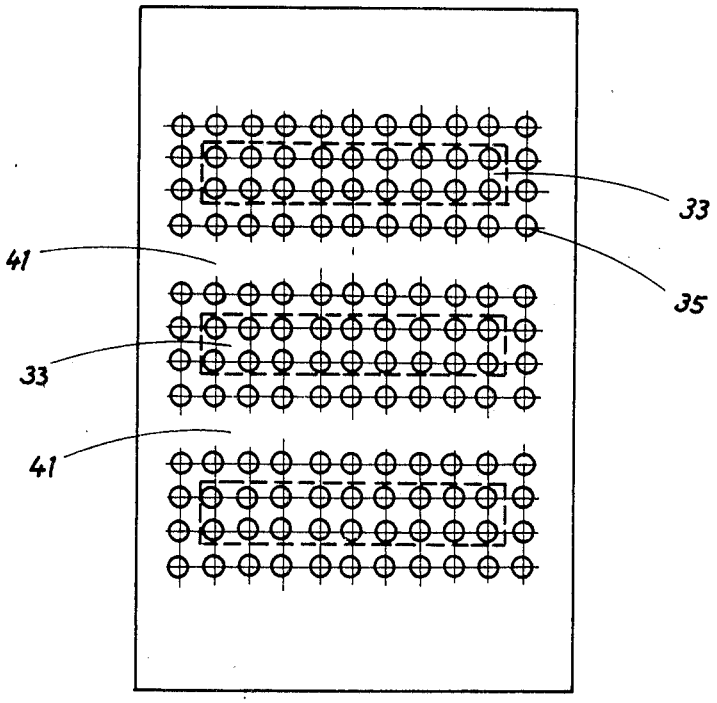
FIG. 18 is a plan view of the nozzle plate of the arrangement of FIG. 17 which is disposed above the charge.

In FIGS. 17 and 18 there is finally shown a case of quenching a charge 11*a* which consists of workpieces for which the critical cooling speeds that are required are not very high, so that taking account of the small wall thickness of the articles they can be cooled with flow of gas parallel to the surfaces. For this purpose, a nozzle plate 20 is provided above the charge 11*a* consisting of three workpieces 33, while blank plates 21 are set in the nozzle box 18 on both sides of the charge 11*a*.

The nozzle openings 35, as shown in FIG. 17, are again grouped in three rectangular areas corresponding to the three workpieces 33 between there extend gas-impermeable regions 31. As shown at 32 the charge 11*a* is again brought partway towards the nozzle plate 20 by means of the rising and falling platform 29.

The nozzle openings 35 in the various nozzle plates described above may be simple apertures in a plate or, if desired, for instance for high-velocity air flow, these openings may be shaped with collars, inserted tubes either straight or flaring, or the like. Round apertures in a plate, as shown in the drawings, have been found to be satisfactory, in a wide range of applications, and such nozzle plates are of course economical to make.

In the above-described illustrative examples, nozzle openings 35 of the same diameter have been provided in the nozzle plates 20 and 20*a* in different nozzle patterns.

In principle, it is also possible and may in particular cases be practical, to vary the diameter of the nozzle openings 35 according to the particular requirements at their respective locations and also to use nozzle openings of different shapes, for example in the shape of slots. It is furthermore possible for the nozzle plates 20*a* to have, instead of a portion 40 protruding into the cooling chamber 3, a region 40 set back so as to enlarge the active part of the cooling chamber rather than to narrow it. For special cases the chamber can be constituted in such a way that a nozzle plate may be present in the region of the charge base surface in order to make possible the blowing of gas onto the charge 11*a* from below.

The drive motors 10 of the fan can be controlled or regulated in order to make possible the setting of the cooling gas velocity at a.desired value in the cooling chamber 3. The maximum cooling gas pressure, as a rule, lies at about 2 bars absolute. Where necessary, however, it could also be higher.

In the new industrial furnace of this invention, cooling intensities are obtained in the cooling chamber 3 which correspond to those reached in conventional and commercially available vacuum furnaces provided with high-pressure gas quenching. Such conventional vacuum furnaces (predominantly single-chamber furnaces) must operate with cooling gas pressures of, for example, 5 bars, absolute, in order to obtain a cooling effect which is comparable to that obtained in the present new industrial furnace in its cooling chamber 3 even at a cooling gas pressure of 2 bars, absolute. The decisive advantage of the low cooling gas pressures that are thus usable lies in a substantial saving of cooling gas (especially nitrogen) during a heat-treatment cycle, a saving that signifies correspondingly high cost savings. Low cooling gas pressures, moreover, permit the construction of cost effective treatment plants and installations which do not require the type of official permits and special inspections that are involved when higher pressures are used.

We claim:

1. Industrial vacuum furnace for heat treatment of metallic workpiece having separate chambers at least including a chamber for heating said workpieces and a cooling chamber for utilizing a circulating gas to quench or cool or to quench and cool said workpieces, said furnace also having means for propelling said gas in circulation and for extracting heat from said gas in heat-exchanger equipment, said furnace having jet outlets for said gas in said cooling chamber constituted by nozzle orifices on interchangeable nozzle orifice plates in said cooling chamber (3):

a nozzle box (10) of tunnel-shaped configuration having, or the inside of said tunnel configuration, guides for installing said nozzle orifice plates in a manner closing off said nozzle box for discharging said gas towards a furnace charge (11*a*) in said cooling chamber on a plurlaity of sides of said furnace charge, said nozzle orifice plates being thereby capable of disposition so as to at least partly envelop said furnace charge with a cooling gas flow discharge suited for cooling said furnace charge by gas entering said cooling chamber in different directions.

2. Furnace according to claim 1, wherein said nozzle orifice plates are constituted for interchanging dispositions of cooling orifices by groups with variation of at least one of the following parameters: pattern of cooling orifice locations, cooling orifice diameters, spacing of cooling orifices from said furance charge.

3. Furnace according to claim 1, in which at least a few of said interchangeable nozzle orifice plates are each usable to probide at least one of the following types of flow: flow impinging on said furnace charge (11*a*), flow parallel to surfaces of said furnace charge.

4. Furnace according to claim 1, in which said guides of said nozzle box are constituted as slide guides into which said nozzle plates (20,20*a*) are slidably insertable.

5. Furnace according to claim 2, wherein at least one of said interchangeable nozzle orifice plates has a nozzle-bearing portion which, when said plate is inserted in place, protrudes inwardly into said cooling chamber from said nozzle box.

6. Furnace according to claim 2, in which said nozzle box (18) is equipped with at least one interchangeable nozzle plate (20*a*) having a nozzle region recessed into said nozzle box.

7. Furnace according to claim 1, in which said nozzle box is constituted to provide nozzle orifice plates on the top and both side inner walls of said tunnel configuration, said nozzle orifice plate (20,20*a*) constituting at least a major part of said respective inner walls.

8. Furnace according to claim 7, in which at least one blank plate (21) is provided for being detachably set in said nozzle box in place of a nozzle orifice plate.

9. Furnace according to claim 7, in which said nozzle box encloses a space on at least three sides, on each of which one said nozzle orifice plate (20,20*a*) faces said enclosed space, said three sides and said nozzle orifice plates being so disposed that two of them face each other across at least a portion of said cooling chamber and the third is disposed substantially between edges of the other two.

10. Furnace according to claim 2, in which a rising and falling platform (29) for adjusting the height of said charge is included for setting a predetermined spacing between said charge and at least a portion of said nozzle orifices (35).

11. Furnace according to claim 10, in which said furnace also includes an auxiliary chamber below the cooling chamber containing an oil bath for oil-quenching said metal workpieces, and in which said rising and falling platform (29) is constituted so as to be usable for lowering said metal workpieces into said oil bath and raising them therefrom.

* * * * *